United States Patent [19]

Johansson

[11] Patent Number: 4,832,327

[45] Date of Patent: May 23, 1989

[54] SHEET CONVEYER

[75] Inventor: Bernt Johansson, Huddinge, Sweden

[73] Assignee: PMB Vector AB, Stockholm, Sweden

[21] Appl. No.: 186,107

[22] Filed: Apr. 25, 1988

[30] Foreign Application Priority Data

May 21, 1987 [SE] Sweden ..... 8702116

[51] Int. Cl.[4] ..... B65H 33/14; B65H 29/66

[52] U.S. Cl. ..... 271/9; 83/88; 83/155.1; 271/3; 271/69; 271/212; 271/216; 271/275; 271/279; 271/285; 271/299

[58] Field of Search ..... 271/3, 3.1, 9, 69, 279, 271/280, 285, 286, 306, 299, 225, 212, 216, 217, 302, 189; 83/88, 89, 155.1

[56] References Cited

U.S. PATENT DOCUMENTS

| | | | |
|---|---|---|---|
| 2,156,419 | 5/1939 | Zomnir | 271/216 |
| 2,639,772 | 5/1953 | Sandberg et al. | 271/225 V |
| 3,758,365 | 9/1973 | Schilling | 271/62 |
| 4,509,703 | 4/1985 | Grunder | 271/225 X |

*Primary Examiner*—Andres Kashnikow
*Assistant Examiner*—Matthew C. Graham
*Attorney, Agent, or Firm*—Webb, Burden, Ziesenheim & Webb

[57] ABSTRACT

Sheet conveyer intended to take charge of and convey part sheets (2', 2'', 2''') obtained from a main sheet by dividing this into a predetermined number of parts and delivering it out of a cutter simultaneously and side by side. The conveyer includes a number of downward gradient planes corresponding to the number of part sheets. Each plane has a length as viewed in the conveying direction corresponding to the length of a respective part sheet. Adjacent planes are connected with one another by an intermediate portion substantially shorter than the respective plane. The connection of the intermediate portion to the preceding plane is rounded off. Furthermore, carrier elements are arranged so that when the planes have received a respective part sheet, the carrier elements push the last part sheet as viewed in the conveying direction from its plane to a position on top of the next part sheet. Thereafter the two part sheets lying on one another are pushed to a position on top of the following part sheet, etc. until all part sheets are on top of one another. The carrier elements then move the pile of part sheets for further treatment.

10 Claims, 3 Drawing Sheets

SHEET CONVEYER

This invention relates to a sheet conveyor for handling and transporting pre-cut sheets in a stacked array.

There are a great many problems present in the treatment of sheets, especially sheets with printed information which are to be distributed to a great number of receivers where the handling rate is high and the demand for error-free work is great. It is desirable to handle such sheets automatically from the time the information is printed on the sheets until the point when the sheets are placed in envelopes ready for distribution. One stage of this sheet handling envolves the division of an A4 sheet, for example, into three parts, and the subsequent handling of these part sheets thereafter in a high volume and reliable manner. Thus, after printed information or the like has been applied to the sheet in three sections of equal size, the sheet is slit into three such sections. These sections are collected in an intermediate storage area and removed individually by a sheet picking means for further treatment. This known scheme causes a certain delay in the overall conveying operation as there is a risk that the sheet picking means sometimes will malfunction.

It is an object of the present invention to simplify sheet handling and make the sheet handling operation faster and more reliable. This has become possible because the invention provides the combination of features described in detail hereinafter.

The invention will now be described in greater detail in the form of examples with reference to the drawings wherein.

Figure 3:
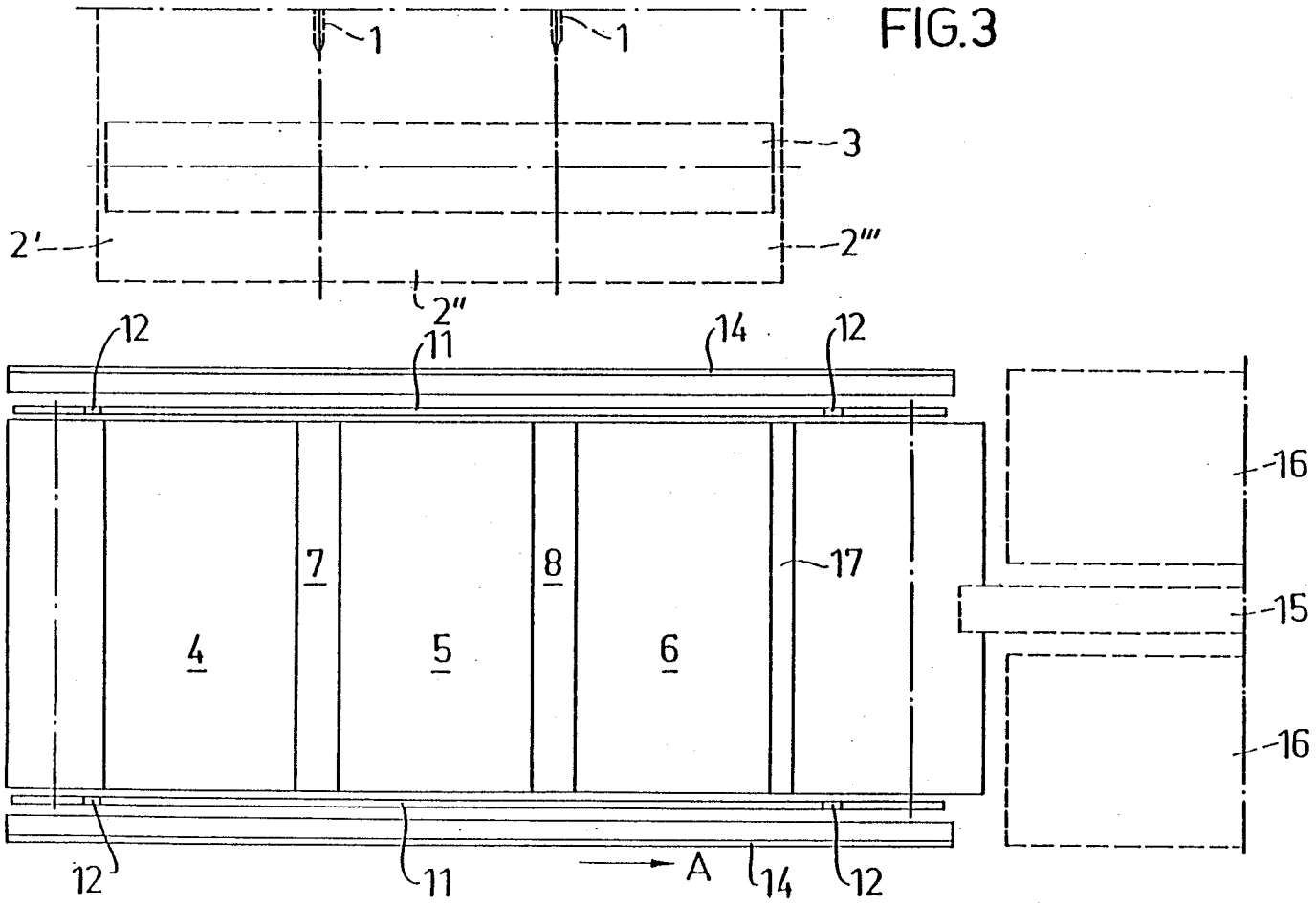
FIG. 3 is a schematic top plan view of the invention.

In the drawings, a cutting machine preceding the sheet conveyor of the invention is drawn with dashed lines. As shown in FIG. 3, two pairs of circular slitting knives 1, for instance, cut an A4 size sheet 2 into three parts 2', 2'', 2''' in cooperation with a pair of feed rolls 3. The cutting machine preceding the sheet conveyor of the invention is a known type of cutting machine and therefore need not be further described herein.

A presently preferred embodiment of the present invention consists of three planes 4, 5 and 6 arranged in a downwardly inclined direction as viewed in a conveying direction indicated by the arrow A. Between the planes 4, 5 and 6 are located intermediate portions 7, 8, the lower connections of which to a preceding plane 4, 5 are substantially curved or rounded off and identified as 9 and 10. The connections of the intermediate portions 7, 8 to the following planes 5, 6 are preferably rounded off as well to achieve a smooth functioning of the device. The planes 4, 5 and 6 form a series of compartments. A part sheet 2', 2'' and 2''', respectively, from the cutting machine is delivered to each of these compartments.

On each side of the planes 4, 5 and 6 are two synchronously operated endless chains 11 to which sheet carriers in the form of shoulders 12 are attached. The distance between two consecutive shoulders 12 is such that there is room for the three planes 4, 5 and 6 between the shoulders, see FIG. 3. Further, it is to be understood that the width of the planes 4, 5 and 6 as seen in the conveying direction is less than the width of the part sheets 2', 2'', 2''' so that the shoulders 12 can engage the rear edges of the part sheets. On each side of the device a pair of guide bars 14 are arranged which guide the part sheets into a correct position transversely as seen in the conveying direction, both when the part sheets are delivered from the cutting device and during their motion along the sheet conveyor. Thus, the distance between the two guide bars 14 is somewhat greater than the width of the respective part sheet.

After the cutting device has delivered a part sheet 2', 2'' and 2''' to each plane 4, 5 and 6, a pair of shoulders 12 are moved to engage the rear edge of the part sheet 2' as seen in the conveying direction and will move this part sheet 2' so that its front edge is lifted upwardly by the sloped intermediate portion 7 and pushed beneath the second part sheet 2'' which projects with its rear edge outside the intermediate portion 7. During continued movement of the shoulders 12, the first part sheet 2' is moved completely beneath the part sheet 2'' to form a stack. The shoulders 12 will then engage sheet 2'' and move the two stacked part sheets 2' and 2'' so that they are lifted by their front edges along the upwardly sloped intermediate portion 8 and pushed under the third part sheet 2'''. Part sheet 2''' which, like the part sheet 2'', projects rearwardly of the intermediate portion 8 to permit the stacked sheets 2' and 2'' to slide beneath it. Thus, when the carriers 12 are on a level with the intermediate portion 8, the three part sheets lie beneath one another forming a well collected lot or stack of part sheets. Thanks to the continued motion of the shoulders 12, thus "bundle" or stack of part sheets will be conveyed further in a coherent unit for continued handling. A device for further transport of the stacks or bundles of sheets is shown schematically in dashed lines and includes coacting belts 15 and conveyor table 16. The handling means 15, 16 is also known per se in the prior art and need not be discussed in detail.

In order that the device on the invention should function faultlessly the rounded portions 9 and 10 must be properly formed and the inclination of the intermediate portions 7 and 8 must not be too great. A suitable inclination of the intermediate portions has been found to be about 45° to the horizontal plane at a presently preferred conveying rate. Of course the inclination angle can be reduced and is dependent on the desired conveying rate.

Figure 4:
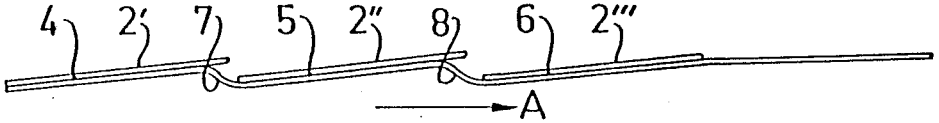
FIG. 4 is a schematic alternative embodiment.
Figure 2:
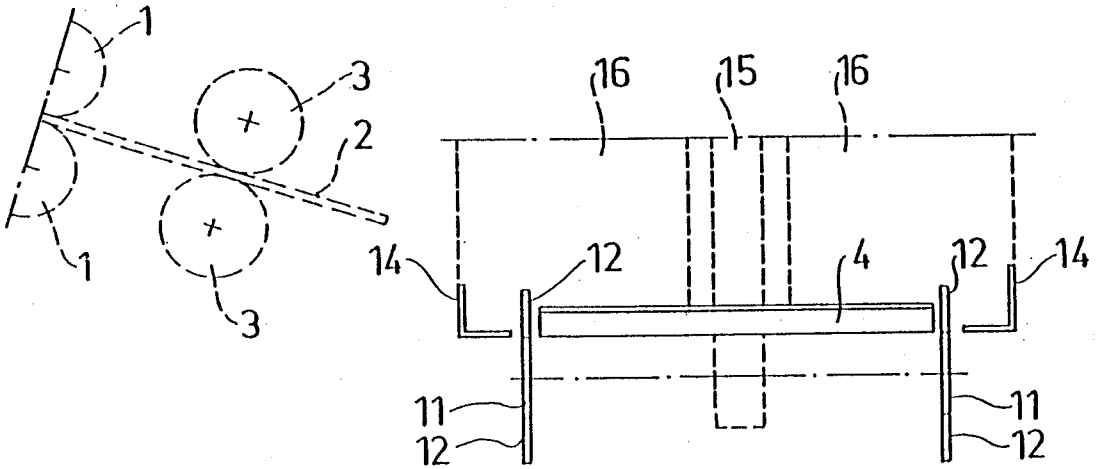
FIG. 2 is a schematic end view of the invention.

FIG. 4 shows schematically an alternative embodiment in which the planes 4', 5' and 6' slope upwardly when viewed in the conveying direction A. The sloped intermediate portions 7', 8' are located between the planes 4', 5' and 6' as previously described. In this case the shoulders 12 will push the last part sheet 2' as viewed in the conveying direction to a position on top of the following sheet 2''. Thereafter these two sheets 2' and 2'' are pushed together over the third part sheet 2''' and this "bundle" is further moved in a coherent unit for the continued handling. In FIG. 4 only the planes with intermediate portions have been depicted in the drawing figure together with the part sheets lying thereon, it being understood that the rest of the device is formed as shown in FIG. 1.

In the first described embodiment in accordance with FIG. 1, "the sheet bundle" is built up from below and in the second embodiment in accordance with FIG. 4, the sheet bundle is built up from above. This can be of importance depending on the desired order of the stacked sheets required in any continuing treatment operations.

Figure 1:
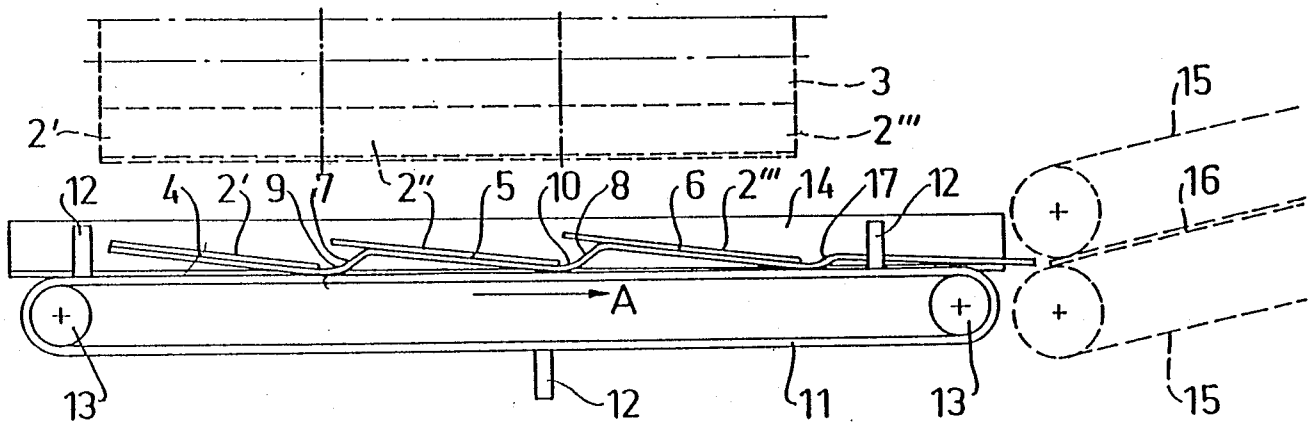
FIG. 1 is a schematic lateral view of the invention.

In connection with FIGS. 1 and 3, a secondary intermediate portion 17 intended to guide the part sheet 2''' from the plane 6 is located after the last plane 6 as viewed in the conveying direction A. However, this intermediate portion 17 can be varied in a plurality of manners and it is possible to omit the secondary intermediate portion 17 completely, as in FIG. 4. Moreover, it is to be understood that means can be arranged in connection with the devices shown, for example, thin fingers or the like can be employed to guide the part sheets down into the compartments formed by the planes 4, 5 and 6 when the part sheets leave the preceding cutting machine. These fingers are not depicted in the drawings because they are known per se in the art.

I claim:

1. Sheet conveyor intended to take charge of and convey part sheets (2', 2'', 2''') obtained from a main sheet by dividing the main sheet into a predetermined number of sheet parts and delivering the sheet parts out of a cutter simultaneously and side by side, characterized by a device comprising a plurality of downward gradient planes (4, 5, 6) arranged in a downwardly sloping manner when viewed in an intended conveying direction (A) of the part sheets and corresponding to the number of said part sheets, which planes each have a length as seen in the conveying direction less than the length of the respective part sheet, adjacent planes being connected with one another by means of an intermediate portion (7, 8) substantially shorter as seen in the conveying direction than a length of the respective planes (4, 5, 6), the connection of said intermediate portion (7, 8) to a preceding plane as seen in the conveying direction being substantially curved (9, 10), and that carrier means (12) are arranged so that when the planes have each received a respective part sheet (2', 2'', 2'''), the carrier means will push a part sheet (2'), from its respective plane (4) to a stacked position beneath a next adjacent part sheet (2'') and thereafter move the two part sheets lying on one another to a stacked position beneath a next following part sheet (2''') and continuing until all part sheets contained in said plurality of planes are stacked on top of one another to form a completed stack after which the carrier means (12) move the completed stack of part sheets for further treatment.

2. Sheet conveyor as claimed in claims 1, characterized in that the intermediate portion (7, 8) is inclined 45° relative to the horizontal plane.

3. Sheet conveyor as claimed in claim 1, characterized in that the connection of the intermediate portion (7, 8) with the following plane (5, 6) as seen in the conveying direction (A) is substantially curved.

4. Sheet conveyor as claimed in claim 3, characterized in that the intermediate portion (7, 8) is inclined 45° relative to the horizontal plane.

5. Sheet conveyor intended to take charge of and convey part sheets (2' 2'', 2''') obtained from a main street by dividing the main sheet into a predetermined number of sheet parts and delivering the sheet parts out of a cutting machine simultaneously and side by side, characterized by a device comprising a plurality of upward gradient planes (4, 5, 6) arranged in an upwardly sloping manner when viewed in an intended conveying direction (A) of the part sheets and corresponding to the number of said part sheets, said planes each having a length as seen in the conveying direction corresponding to the length of the respective part sheet, that adjacent planes are connected with one another by means of an intermediate portion (7, 8) substantially shorter as seen in the conveying direction than a length of the respective planes (4, 5, 6), the connection of the intermediate portion (7, 8) to the preceding plane as seen in the conveying direction being substantially curved (9, 10), and that carrier means (12) are arranged, when the planes have each received a respective part sheet (2', 2'', 2'''), so that the carrier means will push a part sheet (2') from its respective plane (4) to a stacked position on top of a next adjacent part sheet (2'') and thereafter move the two part sheets lying on one another to a stacked position on top of a next following part sheet (2''') and continuing until all part sheets contained in said plurality of planes are stacked on top of one another to form a completed stack after which the carrier means (12) move the completed stack of part sheets for further treatment.

6. Sheet conveyor as claimed in claim 5 characterized in that the intermediate portion (7, 8) is inclined 45° relative to the horizontal plane.

7. Sheet conveyor as claimed in claim 5, characterized in that the connection of the intermediate portion (7, 8) with the following plane (5, 6) as seen in the conveying direction (A) is substantially curved.

8. Sheet conveyor as claimed in claim 7, characterized in that the intermediate portion (7, 8) is inclined 45° relative to the horizontal plane.

9. Sheet conveyor as claimed in claims 1, 5, 3, 2, 7, 6, 4 or 8 characterized in that the planes (4, 5, 6) have a width that is less than the width of the part sheets as seen in the conveying direction.

10. Sheet conveyor as claimed in claims 2, 6, 4 or 8, characterized in that the carrier means consist of shoulders (12) movable on each side of the device and along the planes in the conveying direction and arranged on endless chains (11) or the like.

* * * * *